US009062422B2

(12) United States Patent
Canepari

(10) Patent No.: US 9,062,422 B2
(45) Date of Patent: Jun. 23, 2015

(54) RETAINING DEVICE

(75) Inventor: Enea Canepari, Parma (IT)

(73) Assignee: BETONFORM S.R.L., Gais (IT)

( * ) Notice: Subject to any disclaimer, the term of this patent is extended or adjusted under 35 U.S.C. 154(b) by 0 days.

(21) Appl. No.: 13/984,730

(22) PCT Filed: Feb. 9, 2012

(86) PCT No.: PCT/IB2012/050588

§ 371 (c)(1),
(2), (4) Date: Oct. 18, 2013

(87) PCT Pub. No.: WO2012/107896

PCT Pub. Date: Aug. 16, 2012

(65) Prior Publication Data

US 2014/0044494 A1 Feb. 13, 2014

(30) Foreign Application Priority Data

Feb. 10, 2011 (IT) ..... VR2011A0027

(51) Int. Cl.
*E01F 7/04* (2006.01)
*E02D 29/02* (2006.01)

(52) U.S. Cl.
CPC ..... *E01F 7/04* (2013.01); *E02D 29/0233* (2013.01)

(58) Field of Classification Search
CPC ..... E01F 7/045; E01F 7/02; E01F 7/00; E01F 7/04
USPC ..... 405/262, 284, 302.4, 302.6, 302.7; 256/12.5; 404/6, 9
See application file for complete search history.

(56) References Cited

U.S. PATENT DOCUMENTS 4,759,606 A * 7/1988 McDowell ..... 359/553
5,694,711 A * 12/1997 Cowgill et al. ..... 40/610

FOREIGN PATENT DOCUMENTS

| | | | |
|---|---|---|---|
| EP | 0828897 | | 6/2002 |
| EP | 1728924 | | 12/2006 |
| EP | 1921210 | | 5/2008 |
| EP | 1921210 | A1 * | 5/2008 |
| WO | 97/37085 | | 10/1997 |
| WO | 2010/013209 | | 2/2010 |
| WO | 2010/013210 | | 2/2010 |
| WO | 2010/113124 | | 10/2010 |
| WO | 2011/117790 | | 9/2011 |

OTHER PUBLICATIONS

PCT International Search Report mailed on Jun. 25, 2012 for PCT Application PCT/IB2012/050588 filed on Feb. 9, 2012 in the name of Betonform S.R.L.
PCT Written Opinion mailed on Jun. 25, 2012 for PCT Application PCT/IB2012/050588 filed on Feb. 9, 2012 in the name of Betonform S.R.L.

* cited by examiner

*Primary Examiner* — Doug Hutton, Jr.
*Assistant Examiner* — Patrick Lambe
(74) *Attorney, Agent, or Firm* — Steinfl & Bruno LLP

(57) ABSTRACT

A retaining device is described. The retaining device has a retaining barrier, wherein the retaining barrier has a support frame including at least three arms. The support frame is adapted to assume a non-operating closed configuration and an operating radial configuration. In the operating radial configuration, each arm is oriented along a respective radial direction; in the non-operating closed configuration, at least a first arm is oriented along the same radial direction of the operating radial configuration and the remaining second arms are oriented along a direction substantially parallel to said radial direction of said at least one first arm.

15 Claims, 7 Drawing Sheets

RETAINING DEVICE

CROSS REFERENCE TO RELATED APPLICATIONS

The present application is the US national stage of International Patent Application PCT/IB2012/050588 filed on Feb. 9, 2012 which, in turn, claims priority to Italian Patent Application VR2011A000027 filed on Feb. 10, 2011.

The present disclosure relates to a retaining device. In particular, it relates to a device intended to be used for retaining snow, avalanches, earth, rocks, embankments, i.e. a so-called avalanche, snow, landslide, rock protection or stabilization device, or the like.

Retaining devices for protection against avalanches or landslides or for stabilization purposes, such as those for example described in Italian patent IT1288181, European patent application EP1921210 and European patent application EP1728924, are known.

In particular, an example of a known retaining device comprises a support frame formed by metal beams to which a retaining mesh is fixed. The support frame rests on the ground on one side and is supported by a strut or leg which is secured to the ground, so as to form an inclined T-shaped structure.

In practice, the retaining mesh is arranged substantially perpendicular, or otherwise inclined, with respect to the ground, so as to stop, or at least limit, the advancing movement of the snow or other material to be retained.

In this way, by arranging several rows of such retaining devices along the slopes of the mountains, it is possible to limit the formation of avalanches or landslides or in any case limit significantly the mass thereof.

Although advantageous in many respects, the known retaining devices have a number of drawbacks which are yet to be overcome.

One drawback relates to the difficulty of transportation and assembly.

The known devices have in fact a substantially pyramidal shape which has a large volume owing to both the two-dimensional size of the support frame and the length of the support strut which extends from the support frame forming a T together therewith.

Moreover, it must be considered that the retaining devices, owing to their very function, must be installed typically in hostile locations which are difficult to access, such that often a helicopter is used in order to transport them to the installation site.

This often results in the need to transport the different parts of the disassembled device to the installation site and perform assembly of the device directly on-site.

This operation increases significantly the amount of time required for installation and may pose dangers for the workers, who are required to perform assembly of the device in difficult conditions.

Alternatively, transportation of the pre-assembled device must be performed using special vehicles and the number of devices which can be transported in one journey is very limited.

Similar size-related problems arise also with regard to transportation by road of the retaining devices from the production plant to the installation yard and as regards their storage in the production plant and at the yard site.

The present disclosure is therefore based on the technical problem of providing a retaining device which is able to overcome the drawbacks mentioned above with respect to the prior art and/or which is able to achieve further advantages.

This is obtained by providing a retaining device according to the independent claim 1. Particular embodiments of the subject of the present disclosure are defined in the corresponding dependent claims.

A retaining device according to the present disclosure is useful for facilitating transportation thereof, owing to the fact that its volume in a non-operating configuration is smaller than the volume in an operating configuration.

In fact, the support frame is able to assume a non-operating closed configuration and an operating radial configuration. The retaining barrier in the non-operating configuration (i.e. when the barrier is closed) has a mainly elongated shape with a transverse dimension which is much smaller than in the operating configuration (i.e. when the barrier is open and the arms are arranged radially).

In other words, a retaining device according to the present disclosure has a foldable or collapsible structure which is useful for reducing greatly the volume of the device when the latter is not installed.

As a result, the retaining device may be easily transported in an already substantially assembled condition, reducing to a minimum the operations required at the installation yard.

Compared to the prior art, a greater number of retaining devices may be transported by road in a single journey.

Storage of the retaining devices not yet used is likewise facilitated by the smaller volume.

According to some embodiments, the parallel-arm configuration is substantially coplanar with the radial configuration, i.e. the second arms (or movable arms) move relative to the first arm, without coming out of the plane of the radial arrangement.

The first arm or the first arms may therefore be fixed.

This aspect is useful for simplifying the manufacture of the retaining device so as to reduce both the overall number of separate parts (and the labour required for assembly of the retaining device) and the number of movable arms (and the operations which must be performed in order to obtain the radial configuration during installation).

For example, in the case of a support frame with three arms arranged in the shape of a T or Y, it is sufficient for only one of them (in particular the arm which forms the leg of the T or the Y) to be movable relative to the other arms; in the case of a support frame with four arms arranged in the manner of an X, it is sufficient for only two opposite arms to be movable relative to the other ones.

It should be considered moreover that, when the retaining device is installed, it may be preferable to lock the second arms in the operating radial configuration, in order to prevent an accidental movement thereof towards the non-operating closed position and prevent the support frame from being able to modify its shape under load. Therefore, a minimum number of movable arms involves a corresponding minimum number of movable connections which must be locked and therefore reduces to a minimum the number of operations to be performed during installation.

According to some embodiments, the device comprises a support strut which is connected to the retaining barrier via an articulated joint. The support strut is movable between a first angular position and a second angular position relative to the retaining barrier: in the first angular position, the support strut is in a substantially T-shaped arrangement with the retaining barrier, while in the second angular position the support strut is substantially parallel to the arms of the support frame in the non-operating closed condition, i.e. it is substantially parallel to the radial direction of the at least one first arm.

This aspect is useful for obtaining a retaining device in the shape of a T when it is installed, as occurs for the devices of the prior art, and for obtaining a device with a minimum volume when it is not installed and must be transported and/or stored.

In fact, the support strut in the second angular position is parallel to the mainly elongated shape of the retaining barrier when it is closed and therefore does not increase significantly the transverse dimensions of the retaining device when not installed.

Furthermore, according to some embodiments, the articulated joint between the support strut and the retaining barrier comprises a spherical hinge which is convertible reversibly into a cylindrical hinge, for example through a pin to be inserted inside a through-seat formed in the body of the spherical hinge. When the articulated joint operates as a cylindrical hinge, the movement of the support strut is limited to a movement between the first angular position and the second angular position, i.e. the strut is able to move only in one plane which is perpendicular to the retaining barrier.

This aspect is useful for obtaining a retaining device in which, when the device is installed on-site, the articulated joint is a spherical hinge which may allow a multidirectional articulated movement between the retaining barrier and the support strut so as to adapt to the load acting on the retaining barrier, as occurs in some known retaining devices. When instead the retaining device is not installed and must be transported and/or stored, the articulated joint is a cylindrical hinge which limits the movements of the support strut and prevents rotation thereof in the plane of the radial arrangement, thus preventing the support strut from coming out accidentally of the mainly elongated shape of the closed retaining barrier.

Basically, this allows a small volume to be maintained during transportation.

Moreover, during installation, said limitation of the movements of the support strut prevents the strut itself from deviating laterally and from accidentally creating an obstacle for the operations or from inadvertently striking the installation workers.

According to other embodiments, the support strut is supplied detached from the retaining barrier and is connected to it only during installation on-site. In these embodiments, the articulated joint may not be present; for example, the support strut may be connected to the retaining barrier through insertion inside a special seat or using other known methods.

According to other embodiments, the retaining barrier on-site is supported by support means which do not comprise a strut, such as tie members or flexible cables for example.

Further advantages, characteristic features and the modes of use of the subject of the present disclosure will become clear from the following detailed description of a preferred embodiment thereof, provided by way of example and not for limitative purposes.

It is clear, however, that each embodiment of the subject of the present disclosure may have one or more of the advantages listed above; in any case it is not required that each embodiment should have simultaneously all the advantages listed.

Reference shall be made to the figures in the accompanying drawings in which.

Figure 1:
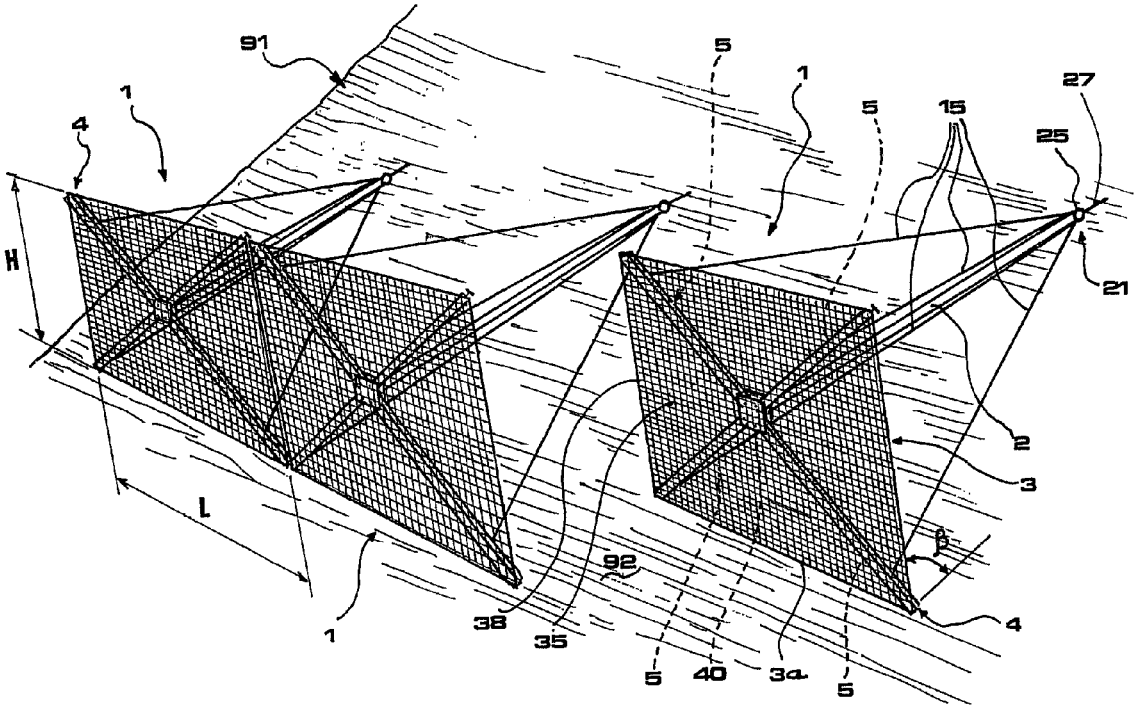
FIG. 1 shows a perspective view of a number of retaining devices according to the present disclosure, installed on-site on a slope.

With reference to the figures, a retaining device according to the present disclosure is indicated by the reference number 1.

Said retaining device 1 may be used in different fields: for example it may be used to retain snow (so-called snow protection device), for protection against avalanches (so-called avalanche protection device), for stabilizing or retaining earth or embankments (so-called stabilization device), for protection against falling rocks (so-called rockfall or landslide protection device), or for other similar uses.

In the embodiment shown, the retaining device 1 is a stabilization device, for example able to be arranged on an unstable slope 91 of a mountain and fixed there in ways which will be described in greater detail below, so as to stop or limit the movement downhill of earth or rocks on the uphill side of the device 1.

The retaining device 1 comprises a retaining barrier 3 and a support strut 2 connected to the retaining barrier 3.

In particular, when the retaining device 1 is installed on-site, the support strut 2 and the retaining member 3 are in a substantially T-shaped arrangement or configuration, where the support strut 2 forms the core of the T and the retaining barrier 3 forms the flange of the T.

In the example, the retaining device 1 is installed on the ground 92 in the configuration of an overturned T so that one side 3*a*, or bottom side, of the retaining barrier 3 rests on the ground 92 and forms a certain angle β with the ground 92. In particular, the retaining barrier 3 may be arranged substantially perpendicular to the ground 92 or inclined downhill.

The support strut 2 acts as a prop or support for the retaining barrier 3 in order to prevent the latter from being able to be overturned or moved under the weight of the material to be retained.

The support strut 2 has a first end 21, or uphill end, which can be connected to the ground 92 via suitable fixing means, said fixing means for example comprising a ring 25 attached to the first end 21 of the support strut 2 and a tie member 27 which connects the ring 25 to an anchoring device (not shown) embedded in the ground 92. Fixing of the support strut 2 to the ground 92 allows the retaining device 1 to be kept in a pre-chosen position. These fixing means may be formed in ways known to the person skilled in the art and consequently will not be further described. For further details, see for example Italian patent IT1288181 and European patent application EP1921210.

A second end 22, or downhill end, of the support strut 22 is associated with or connected to the retaining barrier 3, in particular to a central region thereof, in ways described below.

Figure 2:
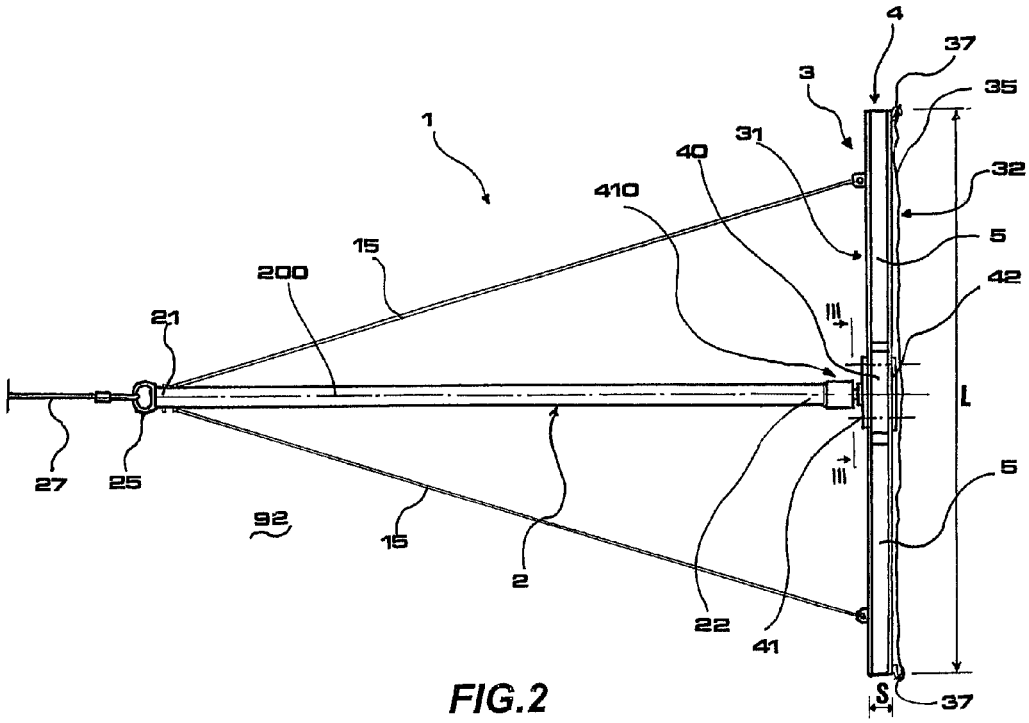
FIG. 2 shows a top plan view of a retaining device according to the present disclosure.
Figure 3:
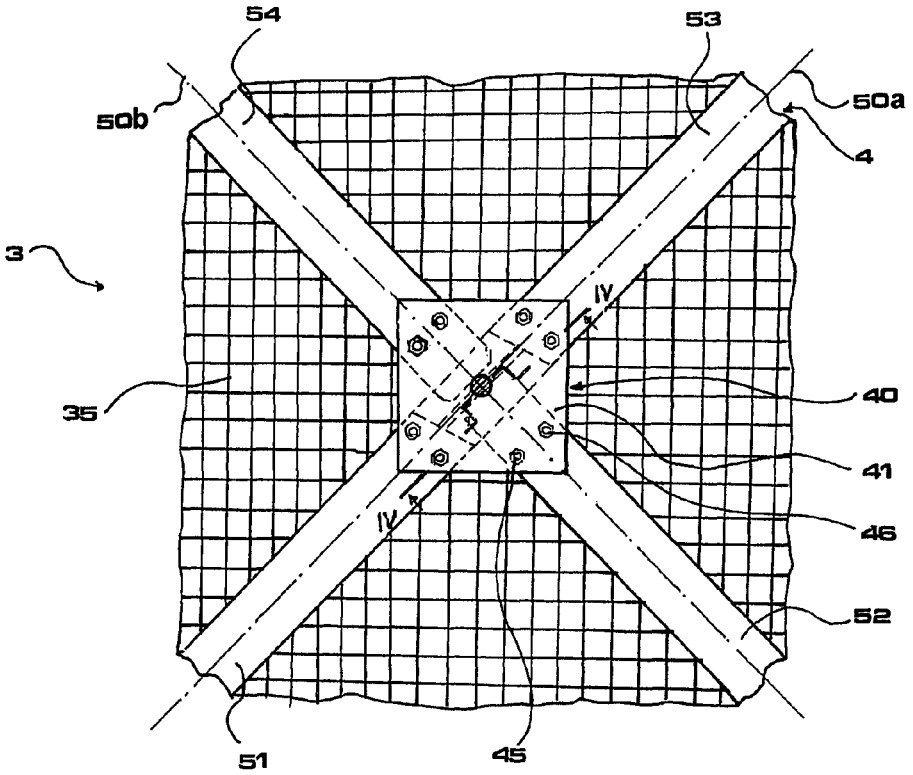
FIG. 3 shows a cross-sectional view, according to the cross-sectional line III-III, of an enlarged detail of the retaining device according to FIG. 2.
Figure 4:
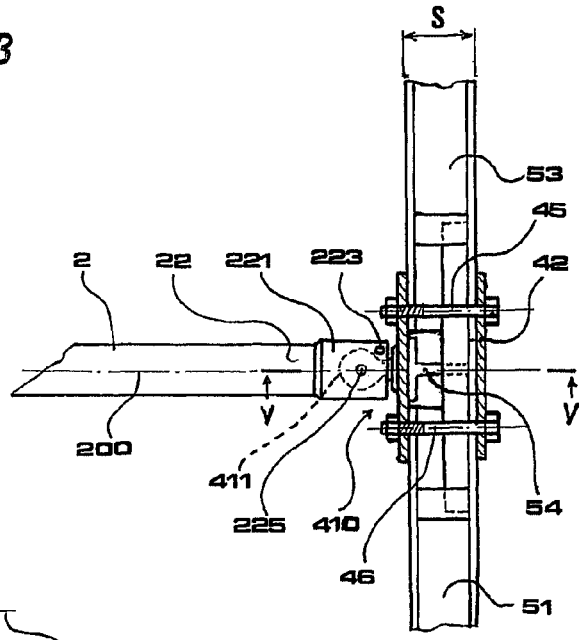
FIG. 4 shows a cross-sectional view, according to the cross-sectional line IV-IV, of the detail according to FIG. 3.
Figure 5:
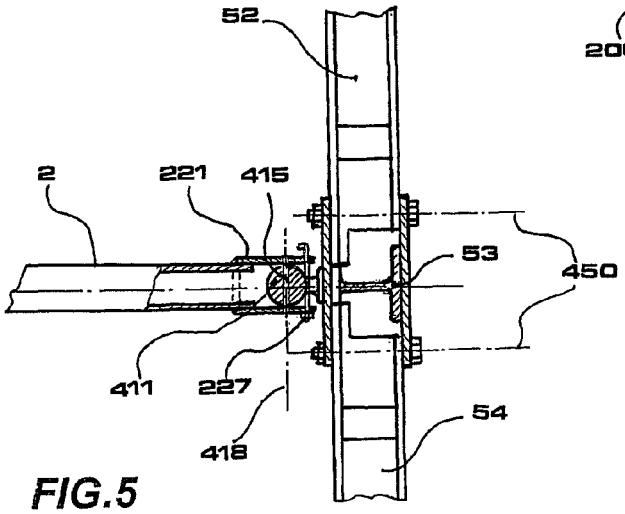
FIG. 5 shows a cross-sectional view, according to the cross-sectional line V-V, of the detail according to FIG. 4.

In the example, as shown in particular in FIGS. 1 to 3, the retaining barrier 3 comprises a support frame 4 and a retaining mesh 35 which is fixed to the support frame 4, for example by means of hooks 37.

The support frame 4 includes at least three arms 5 which are mounted on a central member 40 to which also the support strut 2 is connected.

In the example shown, the support frame 4 comprises four arms 5: two first arms 51, 53 and two second arms 52, 54. Below, each of said arms will be indicated generally by the reference number 5 when it is not relevant whether it is a first arm or a second arm.

In an operating configuration of the support frame 4 (for example when the retaining device 1 is installed on-site) the arms 5 are splayed with respect to each other: two successive arms form an angle relative to each other. In other words, as shown in detail in FIGS. 3 and 6, the arms 5 in the operating configuration are arranged radially and extend from the central member 40 to which they are fixed. In the operating radial configuration, each arm 5 is oriented along a respective radial direction 50*a*, 50*b*.

In particular, this radial arrangement is substantially flat: for example, the arms 5 are coplanar with each other (as visible for example in the top plan view of FIG. 2).

In the example shown, the first arms 51, 53 are aligned with each other and the second arms 52, 54, which are arranged on the opposite sides to the first arms 51, 53, are aligned with each other in the operating configuration. Basically, the first arms 51, 52 are arranged along a first diagonal 50*a* of the retaining barrier 3 and the second arms 52, 54 are arranged along a second diagonal 50*b* of the retaining barrier 3, so as to form an X or a Saint Andrew's cross. The central member 40 is located in the region of intersection between the first diagonal 50*a* and the second diagonal 50*b*.

Said diagonals 50*a*, 50*b* correspond to the radial directions of the respective first arms 51, 53 and second arms 52, 54 in the radial configuration and also to their longitudinal central axes 50.

In the example, the first arms 51, 53 form an angle $\alpha$ of 80 degrees with the second arms 52, 54.

In particular, the support frame 4 has a substantially quadrangular shape, as does the retaining barrier 3.

The support frame 4 extends mainly along two dimensions, i.e. its overall thickness S is substantially smaller than its width L and its height H, these latter two dimensions being substantially comparable to each other in terms of order of magnitude. The support frame 4 defines a first face or side 31, or uphill side, of the retaining barrier 3, while the retaining mesh 35 is situated on a second face or side 32, or downhill side, which is opposite to the first face 31.

The central member 40 comprises a first plate 41 and a second plate 42, which are arranged on opposite sides of the region of intersection between the first diagonal and the second diagonal of the retaining barrier 3, along the first face 31 and second face 32, respectively. Therefore, the ends of the arms 5, in the region of the central member 40, are enclosed between the first plate 41 and the second plate 42.

Each arm 5 is fixed to the central member 40 by means of a respective pair of bolts 45, 46. For this purpose, the central member 40 and each arm 5 comprise respective first seats 47*a*, 47*b* and respective second seats 48*a*, 48*b* for receiving the bolts 45, 46. These seats 47*a*, 47*b*, 48*a*, 48*b* are basically through-holes which pass through the first plate 41, the arm 5 and the second plate 42.

For each arm, a first bolt 45 is inserted inside the first seats 47*a*, 47*b* and clamped with a respective nut 451, while a second bolt 46 is inserted inside the second seats 48*a*, 48*b* and clamped with a respective nut 461.

With respect to a longitudinal central axis 50 of the arm 5, the first seats 47*a*, 47*b* are located on the opposite side to the second seats 48*a*, 48*b*. In the example, each plate 41, 42 is provided with eight through-holes, i.e. two through-holes (first seat 47*a* and second seat 48*a*) for each arm 5. Each arm 5 is provided with two through-holes (first seat 47*b* and second seat 48*b*) which, when the arm 5 is in the operating position, are arranged matching the respective holes 47*a*, 48*a* in the plates 41, 42.

In the embodiment shown, the first arms 51, 53 form a single piece, i.e. are successive parts or sections of a same beam 56 which passes through the central member 40; basically, the first arms 51, 53 are physically continuous with each other. The second arms 52, 54 are structurally independent of each other, i.e. are parts of beams which are discontinuous.

In particular, the arms 5 are formed by a beam with an I-shaped cross-section, having a core 57*a* and two flanges 57*b*, 57*c* on opposite sides of the core 57*a*.

In the region of the central member 40, where the arms 5 converge together, the beam 56 which forms the two first arms 51, 53 has a notch or recess 58 formed in a first flange 57*b* and part of the core 57*a*.

The ends of the second arms 52, 54 in the region of the central member 40 (i.e. at the intersection with the first arms 51, 53) have in turn an incision 59 in the second flange 57*c* and part of the core 57*a*. This allows the arms 5 to be arranged coplanar with each other so as to form a support frame 4 which is substantially flat and has a thickness S equal to the height H5 of the arms 5.

Moreover, by forming the recess 58 in the first flange 57*b* of the first arms 51, 53 and the incision 59 in the second flange 57*c* (i.e. in the flange opposite to the first flange 58*b*) of the second arms 52, 54, the first arms 51, 53 and the second arms 52, 54 substantially complement each other in the intersection region.

Consequently, the overall contact area between each of the plates 41, 42 and the arms 5 is maximized, thus improving the solidity of the support frame 4 as a whole.

The arms 5 may comprise reinforcing elements 57*h* which connect the first flange 57*b* to the second flange 57*c*. The beam 56 may also comprise reinforcing elements 57*g* which are fixed to the core 57*a* in the region of the recess 58. Similar reinforcing elements may be provided for the second arms 52, 54 in the region of the incision 59.

Means 410 for performing connection to the support strut 2 are associated with the first plate 41, i.e. with the plate arranged on the uphill side 31 of the retaining barrier 3. It should be noted that, in the example, the connection means 410 are arranged substantially at a central point of the retaining barrier 3, i.e. at a point defined by the convergence of the arms 5, i.e. at the centre of the radial arrangement.

In order to allow the retaining barrier 3 to vary its inclination relative the support strut 2, said connection means 410 comprise an articulated joint, such as a simple hinge (i.e. a cylindrical hinge) or a spherical hinge for example.

In the embodiment shown, the articulated joint 410 comprises a substantially spherical element 411, which is fixed by means of welding to the first plate 41, and a casing or shell 221 attached to the second end 22 of the support strut 2. The shell 221 has a substantially C-shaped form and defines a cavity for receiving the spherical element 411. A locking bolt 227 (or alternatively a peg) is also provided, being inserted transversely between the two sides of the C-shape through special holes 223 and passing in the vicinity of the first plate 41, in particular inside a groove between the latter and the spherical element 411. The locking bolt 227 thus arranged prevents extraction of the support strut 2 from the spherical element 411.

A joint forming a spherical hinge with a multiple degree of freedom is thus obtained, allowing the support strut 2 to assume any spatial angle with respect to the retaining barrier 3 and to rotate about its longitudinal axis 200.

Moreover, the spherical element 411 includes a seat 415 for removably receiving a pin or bolt 229. In the example, this seat 415 is a hole passing through the spherical element 411 and having a longitudinal axis 418 substantially parallel to the first plate 41. The shell 221 mounted on the support strut 2 has corresponding holes 225 for allowing insertion of the pin 229.

Insertion of the pin 229 inside the seat 415 and inside the holes 225 allows the spherical hinge of the articulated joint 410 to be converted into a cylindrical hinge, i.e. into a joint with a single degree of freedom, where relative rotation of the retaining barrier 3 and the support strut 2 occurs only about the longitudinal axis 418 of the seat 415.

Basically, the articulated joint 410 equipped with pin 229 inserted in the seat 415 is a cylindrical hinge, while the articulated joint 410 without the pin 229 is a spherical hinge.

The retaining device 1 comprises a plurality of tie members 15, each of which connects a respective arm 5 to the support strut 2, in particular to the first end 21 of the latter. The retaining device 1 thus has overall a substantially pyramidal shape, as shown in FIG. 1.

Moreover, a perimetral cable 38 is arranged along the perimeter of the retaining barrier 3, connecting together the peripheral ends of the arms 5; the perimetral cable 38 acts as a support for the retaining mesh 35. The characteristics of the tie members 15, which are for example flexible elements, and of the perimetral cable 38 may be regarded substantially as belonging to the prior art (see for example Italian patent IT1288181 and European patent application EP1921210).

In addition to the operating configuration described hitherto, the retaining device 1 may also assume a non-operating configuration in which it has a smaller volume and is easier to transport. In particular, the retaining device 1 is in this non-operating configuration before being installed, i.e. during manufacture, storage and transportation of said retaining device 1; the retaining device 1 is in operating configuration during installation on-site.

Figure 7:
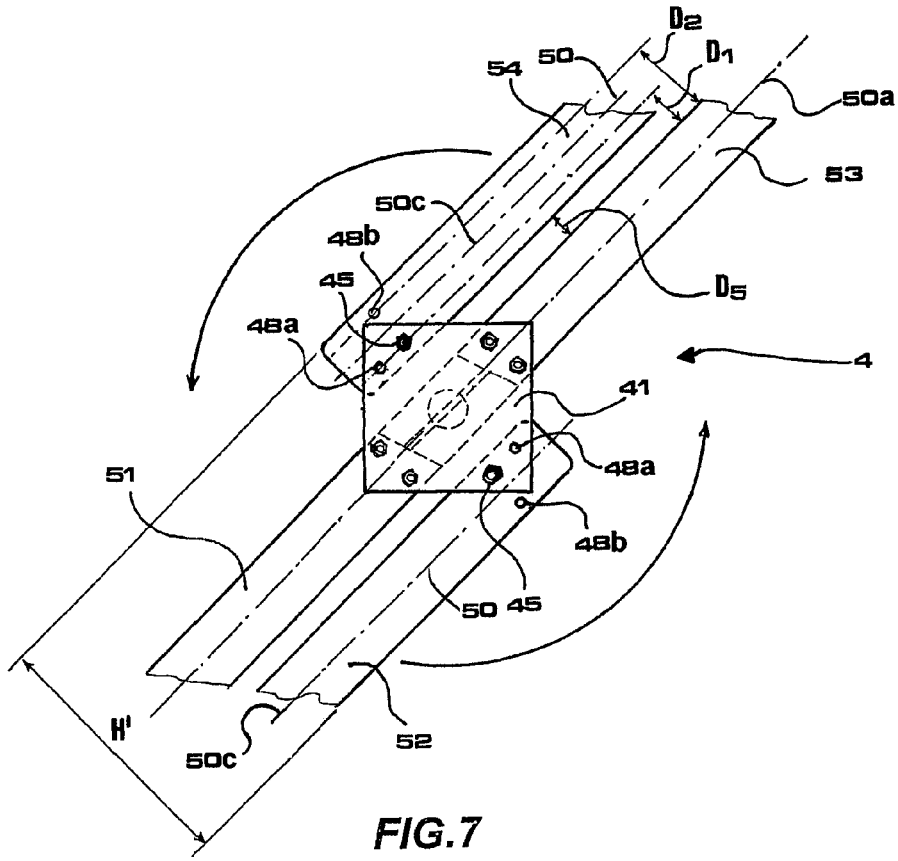
FIG. 7 shows a schematic view of a retaining barrier of the device according to FIG. 1, from which some parts have been removed, in a non-operating closed configuration.
Figure 8:
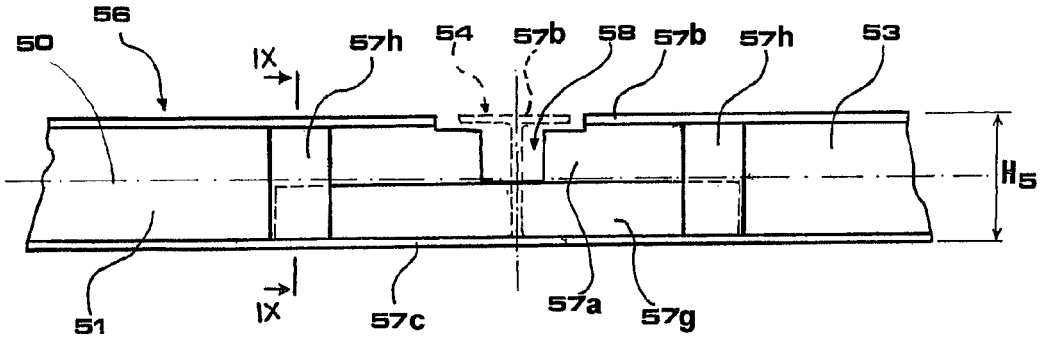
FIG. 8 shows a side view of first arms of the retaining device according to FIG. 6.
Figure 9:
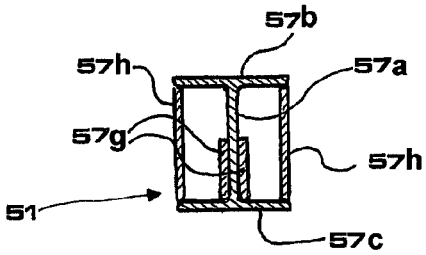
FIG. 9 shows a cross-sectional view, according to the cross-sectional line IX-IX, of the first arms of FIG. 8.
Figure 10:
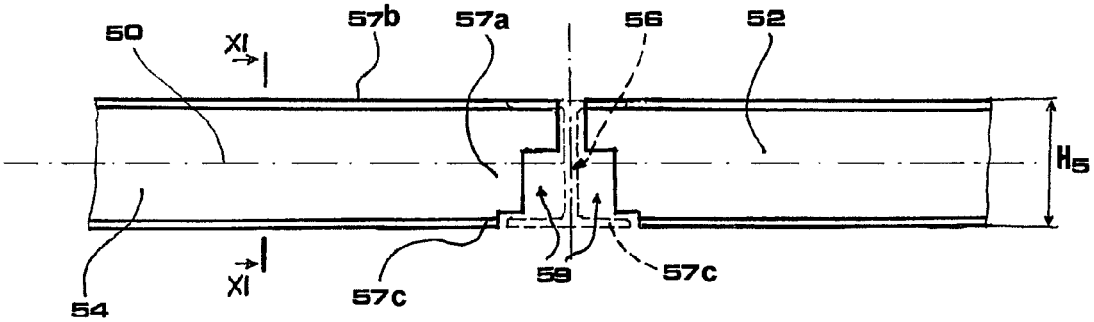
FIG. 10 shows a side view of second arms of the retaining barrier according to FIG. 6.
Figure 11:
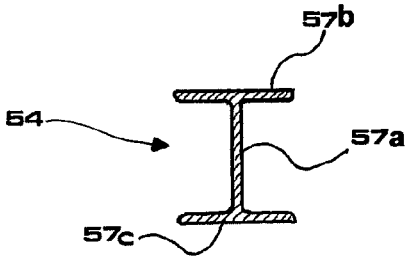
FIG. 11 shows a cross-sectional view, according to the cross-sectional line XI-XI, of the second arms of FIG. 10.
Figure 12:
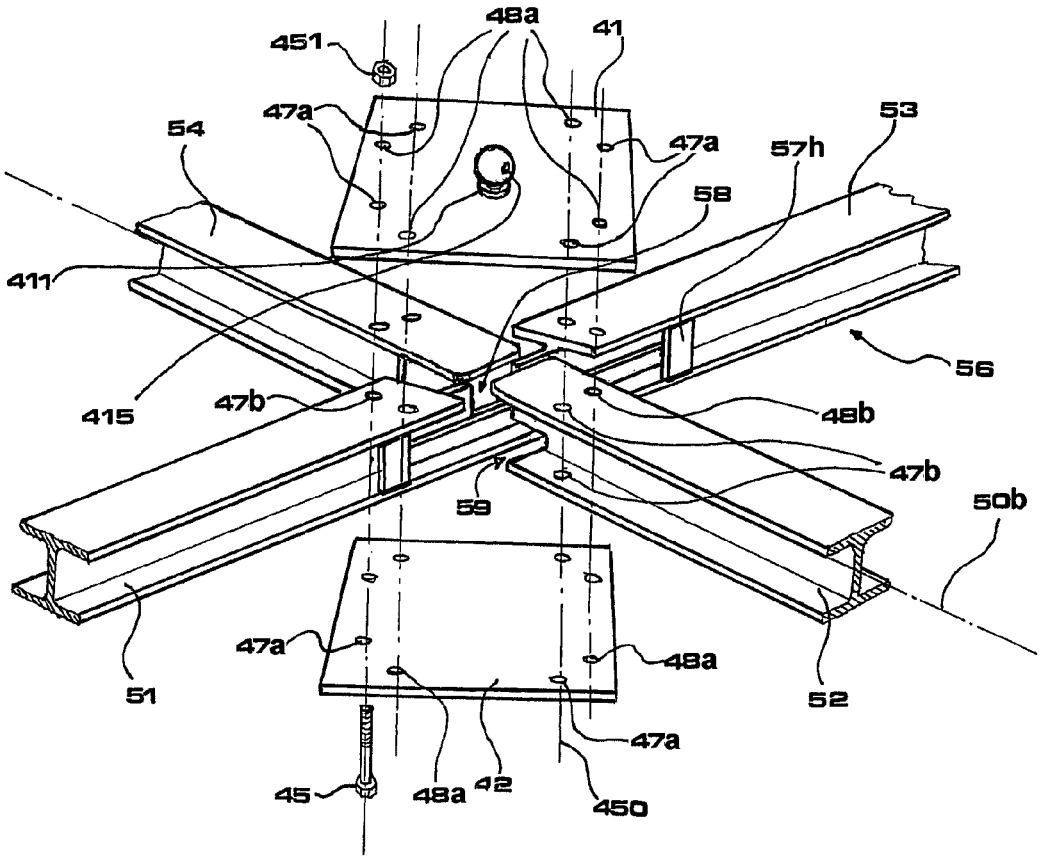
FIG. 12 shows a perspective view of the retaining barrier according to FIG. 6, with parts separated.
Figure 15:
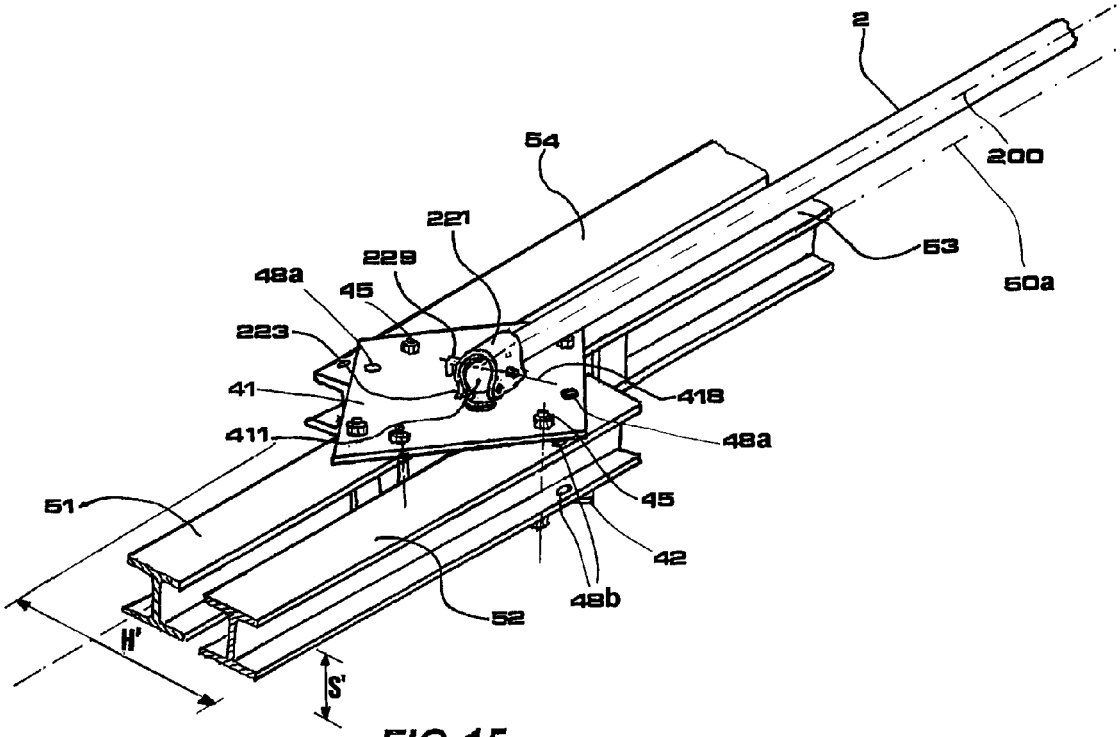
FIG. 15 shows a perspective view of the retaining barrier according to FIG. 7 and a support strut in a second angular position.
Figure 16:
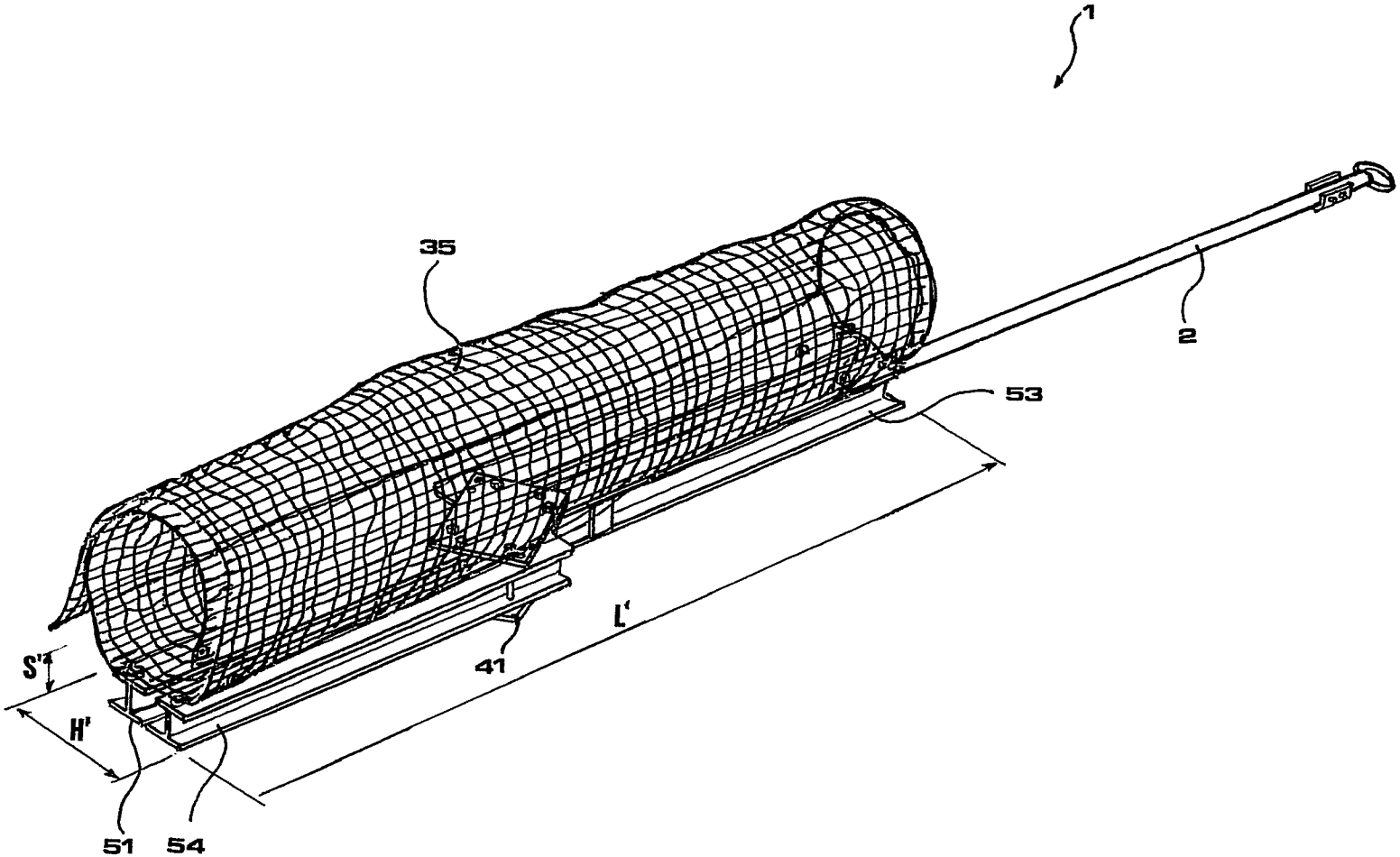
FIG. 16 shows a perspective view of a retaining device according to the present disclosure, in a non-operating configuration.

In the non-operating configuration, shown in FIGS. 7, 15 and 16, the arms 5 are substantially parallel to each other and the support frame 4 is in a closed configuration: the support frame 4 and the retaining barrier 3 have a mainly single-dimensional extension. Differently from the operating configuration, their height H' is substantially less than their width L', while the thickness S' is unchanged with respect to the operating configuration.

This is possible owing to the fact that at least some of the arms 5 are displaceable relative to each other, so as to be arranged parallel instead of radially.

Figure 13:
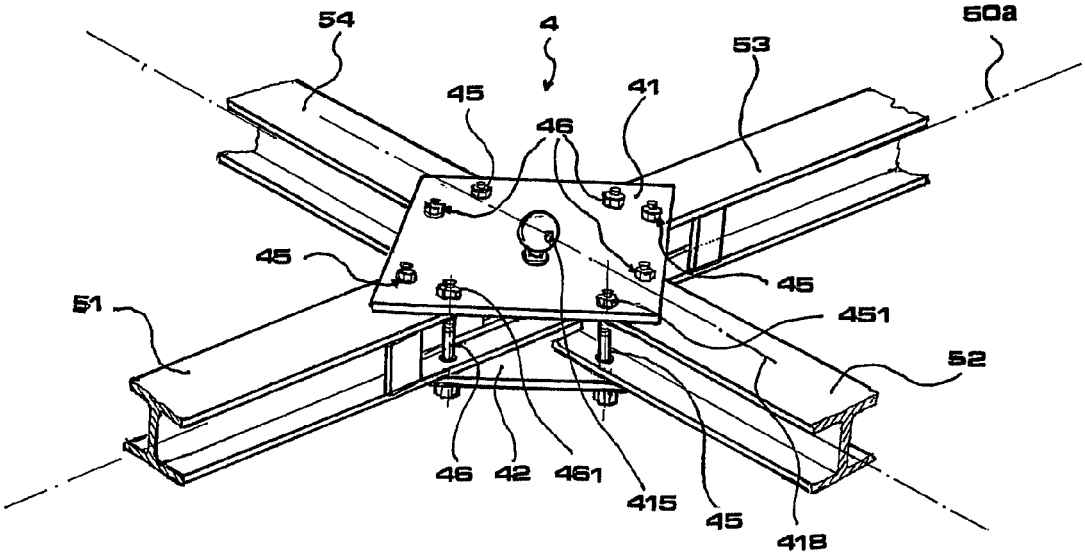
FIG. 13 shows a perspective view of the retaining barrier according to FIG. 6, with parts assembled.

In the non-operating configuration (FIGS. 7 and 15) the arms 5 are substantially parallel to each other, while in the operating configuration (FIGS. 6 and 13) the arms 5 are splayed apart in a radial configuration.

In other words, in the non-operating configuration at least one of the arms 5 (i.e. at least a first arm 51, 53) is oriented along the same radial direction 50*a* as in the operating configuration, while the remainder of the arms 5 (i.e. the second arms 52, 54) are oriented along a direction 50*c* which is substantially parallel to the radial direction 50*a* of said at least one of the arms 5.

In the embodiment shown, the second arms 52, 54 are movable relative to the first arms 51, 53 between a non-operating configuration and an operating configuration.

The two first arms 51, 53 are fixed together, in the example being parts of the same beam 56.

The second arms 52, 54 are therefore movable or displaceable between the non-operating configuration and the operating configuration; the first arms 51, 53 do not vary their position between the non-operating configuration and the operating configuration.

In the non-operating closed configuration, the first arms 51, 53 are oriented along the same radial direction 50*a* as in the operating radial configuration, while the two second arms 52, 54 are oriented along a direction 50*c* which is substantially parallel to the radial direction 50*a* of the two first arms 51, 53.

In particular, in order to ensure that a second arm 52, 54 is movable, only one of the respective bolts 45, 46 (in the example, the first bolt 45) is inserted inside the respective seats (in the example, the first seats 47*a*, 47*b*) such that this bolt 45 acts as a pivot for rotation of the second arm 52, 54 with respect to the central member 40 and with respect to the first arms 51, 53. Where necessary, in order to allow rotation, the nut 451 of the bolt 45 which acts as a pivot element must not be fully tightened. Alternatively, this pivot element may be replaced by a peg, a bolt or other member suitable for acting as a pivot.

The second bolt 46 will be inserted inside the respective second seats 48*a*, 48*b* during installation on-site of the retaining device 1.

Basically, the second arms 52, 54 are pivotably hinged on the central member 40; therefore they are configured to rotate with respect to the central member 40 so as to perform an angular displacement between the non-operating closed configuration and the operating radial configuration. In other words, the movement of the second arms 52, 54 between the non-operating configuration and the operating configuration (and vice versa) is a pivoting rotation relative to the central member 40.

Since the first seats 47*a*, 47*b* and the pivoting bolt 45 extend substantially perpendicular to the plates 41, 42 and to the surface of the retaining barrier 3, the hinging axis 450 of the respective second arm 52, 54 is also substantially perpendicular to the plates 41, 42 and to the plane of the radial configuration.

The rotation of the second arm 52, 54 therefore occurs towards a first arm 51, 53 without coming out of the plane of the support frame; in other words, the movement of the second arm 52, 54 between the non-operating closed configuration and the operating radial configuration is an angular displacement which occurs in the plane of the radial arrangement, i.e. is coplanar with the radial configuration.

The parallel-arm arrangement which the arms 5 assume in the non-operating configuration (or closed configuration) is therefore substantially coplanar with the radial arrangement (or open configuration) which the arms 5 assume in the operating configuration.

In the case of the embodiment shown, in the non-operating configuration the second arms 52, 54 are each adjacent to a respective first arm 51, 53 and the second arms 52, 54 extend on the opposite sides of the central member 40.

Figure 6:
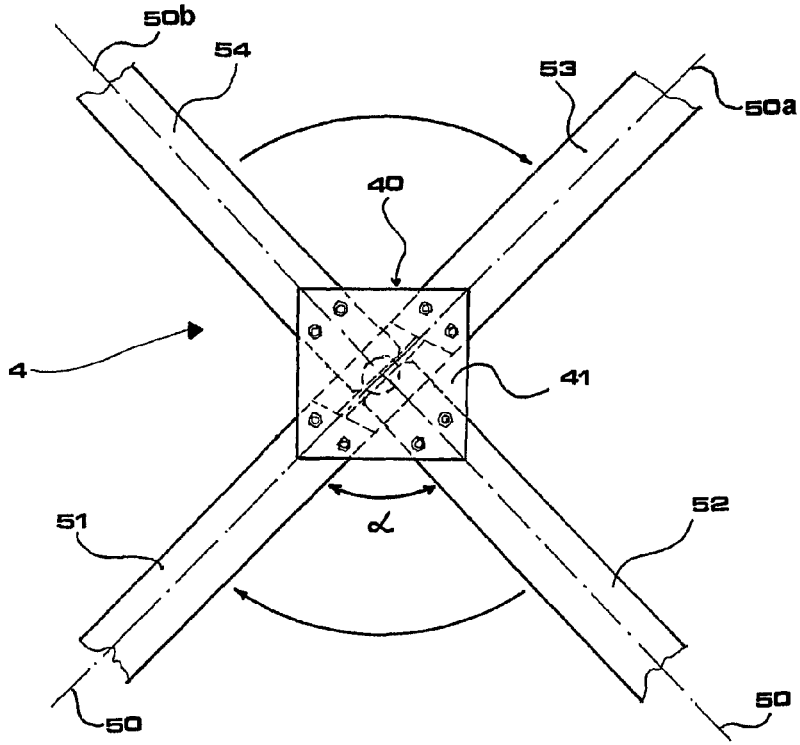
FIG. 6 shows a schematic view of a retaining barrier of the device according to FIG. 1, from which some parts have been removed, in an operating radial configuration.

Basically, during the movement from the non-operating configuration to the operating configuration (or vice versa), the second arms 52, 54 are rotated both in the same direction (in the anti-clockwise direction in FIG. 7 and in the clockwise direction in FIG. 6).

The first seat 47*a*, 47*b* in which the pivoting bolt 45 is located is that closest to the first arm 51, 53 towards which the second arm 52, 54 is displaced in the non-operating configuration.

In the non-operating configuration, the first seat 47*b* (or hinging seat) of the second arm 52, 54 is at a distance D1 from the respective adjacent first arm 51, 53 which is less than the distance D2 of the second seat 48*b* (or locking seat) from the same first arm 51, 53.

Owing to this special feature and suitable shaping of the notch 58 and the recess 59, the second arm 52, 54 does not interfere with the first arms 51, 53 during the angular displacement between the two configurations, i.e. closed configuration and open configuration.

Moreover, the first seats 47*a*, 47*b* are situated outside the profile of the first arms 51, 53 and at a distance D1 from this profile. The distance D1 is chosen with a suitable value so that, in the non-operating configuration, the distance D5 between the second arm 52, 54 and the respective adjacent first arm 51, 53 is at a given—possibly small—value so that the height H' of the support frame 4 is minimal.

The support strut 2 is movable with respect to the retaining barrier 3. In particular, the support strut 2 is movable between a first angular position and a second angular position.

In the first angular position, which is assumed in particular when the retaining device 1 is installed (therefore corresponding to the operating radial configuration of the support frame 4), the support strut 2 and the retaining barrier 3 are in the said T-shaped configuration, as shown in FIGS. 1 to 5.

Figure 14:
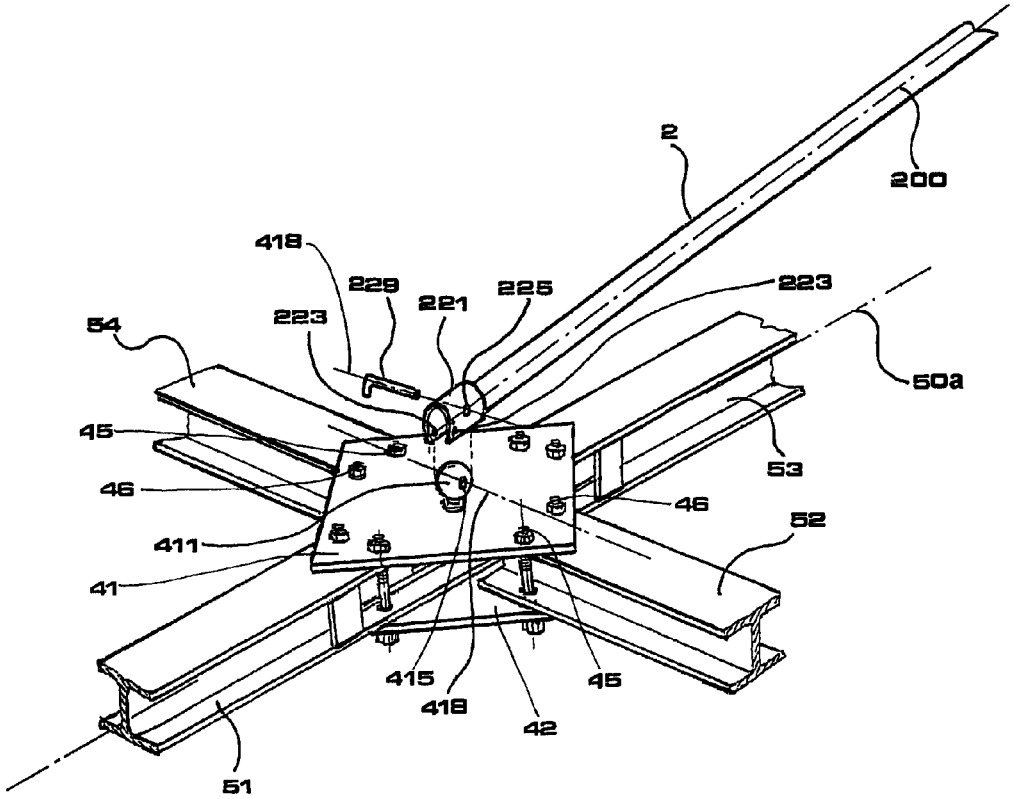
FIG. 14 shows a perspective view of the retaining barrier according to FIG. 13 and a support strut, with parts separated.

In the second angular position, which in particular is assumed during storage and/or transportation of the retaining device 1 (therefore corresponding to the non-operating closed configuration of the support frame 4), the support strut 2 is rotated towards the retaining barrier 3 and in particular is substantially parallel to the radial direction 50*a* of the first arms 51, 52, i.e. to the arms 5 in the non-operating configuration, as shown in FIGS. 14 to 16.

The overall volume of the retaining device 1 in the non-operating configuration is therefore very compact, because the arms 5 and the support strut 2 are parallel to each other and close together.

In the embodiment shown, the support strut 2 in the second operating position is parallel to the first arms 51, 53.

In particular, the seat 415 in the spherical element 411 is formed so that its longitudinal axis 418 is parallel to the retaining barrier 3 and at right angles to the radial direction 50*a* of the first arms 51, 53.

When the pin 229 is inserted inside the seat 415 (and the locking bolt 227 is removed from the holes 223), the articulated joint 410 acts as a cylindrical hinge and limits the movement of the support strut 2 to an angular displacement between the first angular position and the second angular position, i.e. in a plane at right angles to the retaining barrier 3 and parallel to the first arms 51, 53.

As a result, the support strut 2 remains coplanar with the first arms 51, 53, ensuring the compactness of the retaining device 1 during transportation and preventing undesirable and dangerous movements of the support strut 2 outside of this plane during installation.

The retaining device 1 is supplied in the non-operating configuration, with the arms 5 parallel in the closed configuration and the support strut 2 in the second angular position, i.e. parallel to the arms 5 (FIGS. 15 and 16). The pin 229 is inserted inside the seat 415; the second bolts 46 for the second arms 52, 54 and the locking bolt 227 are not mounted on the retaining device 1 or in any case are not operative.

The retaining mesh 35 is connected to only the first arms 51, 53 and is folded up so as to reduce its volume, or alternatively is supplied separately.

The retaining device 1 in the non-operating configuration is transported to the installation site. Owing to its compact and elongated shape which the device assumes in this configuration, transportation is easier than in the case of the known devices.

At the installation site, the arms 5 are splayed apart, arranging them in the operating radial configuration. In the example shown, both the second arms 52, 54 are displaced into the operating configuration.

The second bolts 46 are inserted and fixed inside the second seats 48*a*, 48*b* so as to lock the second arms 52, 54 in the operating configuration.

The second bolts 46 therefore form part of the locking means for locking the second arms 52, 54 on the central member 40 and preventing shape variations of the support frame 4 in the operating configuration.

The retaining mesh 35 is extended and fixed to the support frame 4.

The support strut 2 is brought into the first angular position, restoring the T-shaped configuration. The locking bolt 227 is inserted inside the holes 223 so as to prevent extraction of the support strut 2 from the spherical element 411. The retaining device 1 is fixed to the ground using the known methods. The pin 229 is removed from the seat 415, so that the functionality of the spherical joint 410 is restored.

Should it subsequently be required to remove the retaining device 1 (for example for maintenance or replacement purposes), the abovementioned steps may be performed in the reverse order so that the retaining device 1 assumes again the non-operating closed condition, ready for transportation.

In the embodiment described, the first seats 47*a*, 47*b* and the second seats 48*a*, 48*b* are identical to each other and likewise the first bolts 45 and the second bolts 46 are identical to each other. The method of manufacturing the retaining device 1 is simple because it is not required to form these seats in a different manner depending on their function. In the case of the second arms 52, 54, each of said seats may be used as a locking or hinging seat.

Similarly, a bolt may be used equally well as a pivot element 45 or as a locking element 46, without having to provide two different types of elements.

As an alternative to the bolts, the pivot elements 45 and the locking elements 46 may be pegs, keys or similar elements.

The retaining device 1, in particular the support strut 2, the arms 5 and the central member 40, are for example made of galvanized steel.

The retaining device 1 described here may be subject to numerous variations and modifications.

For example, the first arms 51, 53 made as one piece may be welded directly onto the central member 40, instead of being bolted. In this case, the bolts 45, 46 and the respective seats 47*a*, 47*b*, 48*a*, 48*b* are not required for the first arms 51, 53.

For example, the first arms 51, 53 may be structurally independent of each other, instead of being made as one piece, and optionally may be movable relative to each other so as to be displaced into the non-operating configuration.

For example, the support frame may comprise a greater number of arms (for example six arms) suitably arranged radially in the operating configuration and movable towards a parallel-arm arrangement in the non-operating configuration.

For example, the support frame may comprise only three arms, one or two of which are movable with respect to a first arm (for example by means of a hinging system) so as to assume a parallel-arm arrangement in the non-operating configuration and a radial arrangement in the operating configuration.

The subject of the present disclosure has been described hitherto with reference to preferred embodiments thereof. It is understood that other embodiments relating to the same inventive idea may exist, all of these falling within the scope of protection of the claims which are provided hereinbelow.

The invention claimed is:

1. A retaining device, comprising a retaining barrier including a support frame for supporting a retaining mesh, the support frame including at least four arms, wherein the support frame is configured to assume a non-operating closed configuration and an operating radial configuration, wherein, in the operating radial configuration, each arm is oriented along a respective radial direction with respect to a center axis of the support frame, the arms being coplanar in a plane perpendicular to the center axis, and wherein two first arms of said four arms form a single piece, being successive sections of a beam, and are aligned to each other and oriented in a same radial direction both in the non-operating closed configuration and in the operating radial configuration, and the remaining two second arms are structurally independent of each other, wherein in the non-operating closed configuration, one of the remaining two second arms of the four arms is located on a first side of one of the two first arms and the other of the remaining two arms of the four arms is located on a second side of the other of the two first arms, wherein the first side and the second side are opposite sides relative to the two first arms, the arms remaining coplanar within said plane, the retaining device being configured to be used for retaining snow, avalanches, earth, rocks, or similar materials to be retained, the retaining barrier being configured for receiving a load of material to be retained and for stopping, or at least limiting, an advancing movement of the material to be retained.

2. The retaining device according to claim 1, comprising locking means for locking said remaining second ones of said arms in the operating radial configuration.

3. The retaining device according to claim 1, wherein the support frame comprises a central member whose center coincides with the central axis of the support frame, said arms being mounted on the central member, wherein said two second arms are hinged on the central member and are each configured to rotate relative to the central member to perform an angular displacement between the non-operating closed configuration and the operating radial configuration, wherein said two second arms each rotate around a different rotational axis parallel to and different from the center axis of the support frame.

4. The retaining device according to claim 3, comprising means for locking said two second arms in the operating radial configuration, wherein the locking means is configured for implementing a locking between said two second arms and the central member.

5. The retaining device according to claim 4, each of said two second arms having a respective longitudinal axis, wherein said central member and each of said two second arms comprise each a first seat and a second seat, said first seat and said second seat being on opposite sides of said longitudinal axis, wherein the first seat is intended to receive a pivot element and the second seat is intended to receive a locking element belonging to said locking means.

6. The retaining device according to claim 5, wherein said first seat and said second seat are identical to each other and wherein said pivot element and said locking element are bolts or pegs.

7. The retaining device according to claim 5, wherein said support frame comprises four arms, the two first arms of said four arms are fixed and oriented in the non-operating closed configuration along the same radial direction as in said operating radial configuration, and the two second arms of said four arms are oriented in the non-operating closed configuration along said direction substantially parallel to said radial direction of said two first arms, wherein the two first arms are fixed and aligned with each other, and wherein the two second arms are on opposite sides relative to the two first arms, the two second arms being aligned with each other in the operating radial configuration and being arranged each adjacent to a respective first arm in the non-operating closed configuration, said two second arms being hinged on the central member, wherein, in the non-operating closed configuration, for each second arm, the first seat is at a distance from the respective adjacent first arm which is less than the distance of the second seat from the respective adjacent first arm.

8. The retaining device according to claim 3, wherein said two second arms of said arms each rotate in a same direction around their respective rotational axis when rotating from the non-operating closed configuration to the operating radial configuration, and vice versa.

9. The retaining device according to claim 1, wherein the support frame in the operating radial configuration is substantially coplanar with the support frame in the non-operating closed configuration.

10. The retaining device according to claim 1, further comprising a support strut and an articulated joint, wherein the support strut is connected to the retaining barrier via said articulated joint, the support strut being movable between a first angular position and a second angular position relative to the retaining barrier, wherein the support strut in the first angular position is in a substantially T-shaped arrangement with the retaining barrier, and wherein the support strut in the second angular position is substantially parallel to said radial direction of said two first arms.

11. The retaining device according to claim 10, said articulated joint including a seat configured to removably receive a pin, wherein the articulated joint equipped with the pin received in the seat is a cylindrical hinge limiting the support strut to a movement between the first angular position and the second angular position, and wherein the articulated joint without the pin is a spherical hinge.

12. The retaining device according to claim 1, wherein the two first arms are aligned with each other and wherein the two second arms are on opposite sides relative to the two first arms, the two second arms being aligned with each other in the operating radial configuration, said two first arms being coplanar with said two second arms and the operating radial configuration being substantially flat, the two second arms being arranged each adjacent to a respective first arm in the non-operating closed configuration.

13. The retaining device according to claim 1, wherein the at least four arms have a same height and wherein in the operating radial configuration and in the non-operating closed configuration the support frame has a thickness substantially equal to the height of the arms.

14. The retaining device according to claim 13, wherein the two first arms each comprise a recess region formed within a corresponding flange, said two second arms comprise an incision region formed within a corresponding flange, and wherein said recess region and said incision region are configured such as the two first arms and said two second arms complement each other in an intersection region of a first diagonal associated with the two first arms and a second diagonal associated with said two second arms in the operating radial configuration.

15. The retaining device according to claim 14, wherein the support frame comprises a central member and said central member comprises a first plate and a second plate arranged on opposite sides of said intersection region, and wherein said recess and incision regions are configured to maximize a contact area between the at least four arms and the first and second plates.

* * * * *